United States Patent [19]

Ochmann et al.

[11] Patent Number: 4,797,905

[45] Date of Patent: Jan. 10, 1989

[54] X-RAY GENERATOR INCORPORATING DOSE RATE CONTROL

[75] Inventors: Rudolf Ochmann; Robert H. Zimmermann, both of Hamburg, Fed. Rep. of Germany

[73] Assignee: U.S. Philips Corporation, New York, N.Y.

[21] Appl. No.: 1,305

[22] Filed: Jan. 8, 1987

[30] Foreign Application Priority Data

Jan. 10, 1986 [DE] Fed. Rep. of Germany ..... 3600464

[51] Int. Cl.[4] ..... H05G 1/34

[52] U.S. Cl. ..... 378/108; 378/110; 378/112; 378/116

[58] Field of Search ..... 378/108, 109, 110, 111, 378/112, 116

[56] References Cited

U.S. PATENT DOCUMENTS

| | | | |
|---|---|---|---|
| 3,675,020 | 7/1972 | Siedband et al. | 378/108 |
| 3,783,286 | 1/1974 | Kremer | 378/108 |
| 4,035,649 | 7/1977 | Mester | 378/108 |
| 4,158,138 | 6/1979 | Helstrom | 378/108 |

*Primary Examiner*—Carolyn E. Fields
*Assistant Examiner*—David P. Porta
*Attorney, Agent, or Firm*—Jack E. Haken

[57] ABSTRACT

The invention relates to an X-ray generator including a controller for the dose rate. In order to enable universal use of this controller for different types of examination, use is made of a sampling controller in the form of a microprocessor system. There are provided memories in which the sampling frequency and the adjustment functions are stored for the various types of examination as well as the programs on the basis of which the sampling controller calculates the adjustment values for the various types of examination.

3 Claims, 2 Drawing Sheets

X-RAY GENERATOR INCORPORATING DOSE RATE CONTROL

Figure 1:
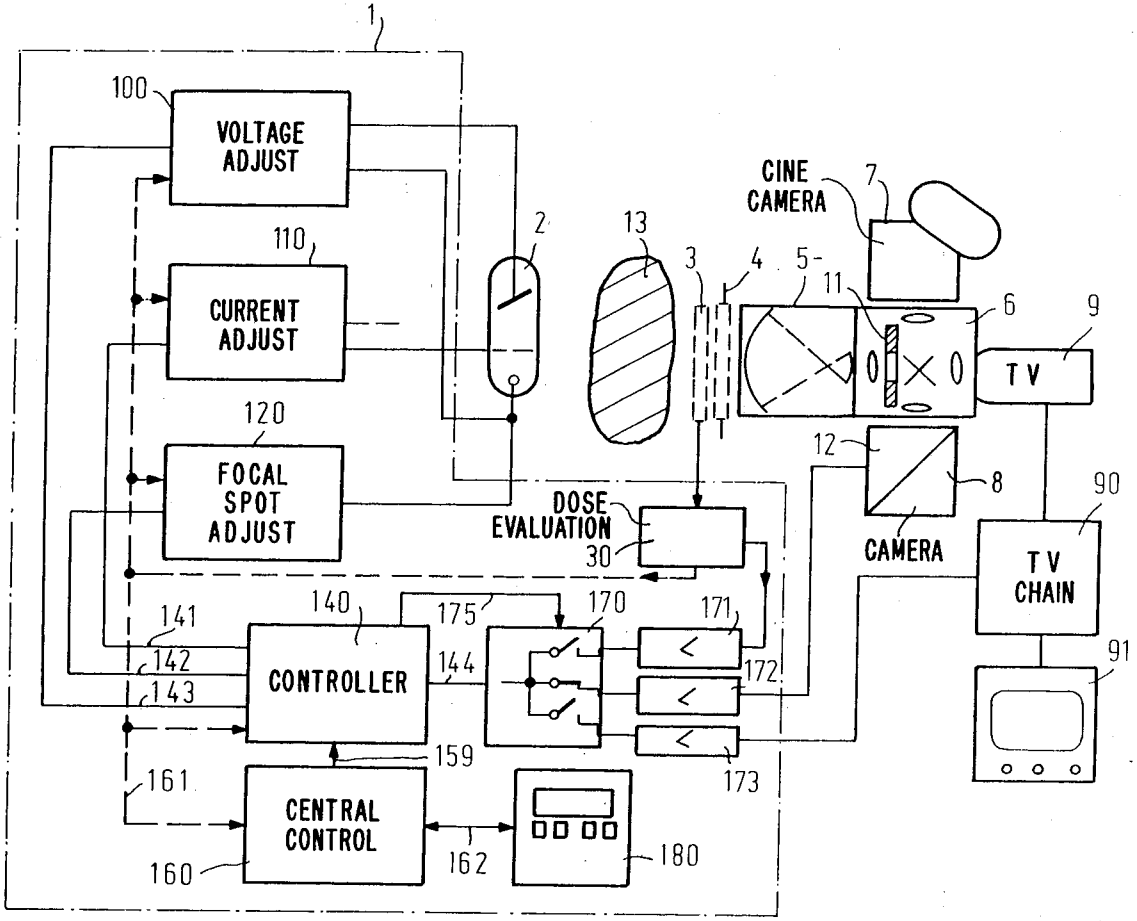

The invention relates to an X-ray generator which includes adjustment means for at least the tube current and the tube voltage, a controller which acts on the adjustment means in dependence of the actual value and a reference value of the dose rate, at least one measurement device for measuring the actual value of the dose rate, and a selection device which can be activated by the operator and which defines the type of examination as well as the reference value of the dose rate.

An X-ray generator of this kind is known from German patent document No. 26 53 252. This generator is suitable for forming both layer images and Bucky images during which the exposure time does not exceed an upper limit value and a lower limit value.

Many types of examination require different control time constants. Cineradiography and pulsed fluoroscopy, for example, require comparatively large time constants in order to avoid the impression of a jittery image. During serialography, involving up to 15 images per second, however, substantially faster dose rate control is required.

Furthermore, different types of examination may require different assignments of the relevant values of tube current and tube voltage. Therefore, for each type of examination a separate controller should be provided when dose rate control is to be realized for the different types of examination using the known X-ray generator.

It is the object of the invention to construct an X-ray generator so that dose rate control suitable for different types of examination can be achieved by simple means.

This object is achieved with a sampling controller which is formed by a microprocessor system. A memory in which the sampling frequency and the adjustment function are stored is provided for the various types of examination. The sampling controller calculates, in accordance with the adjustment function and a program stored in a further memory, the values for the next sampling interval and controls the adjustment means accordingly.

The sampling frequency of the sampling controller, and hence the speed of control, can be determined by means of a programmable counter which is included in the microprocessor system and which receives a value which corresponds to the sampling interval. The same holds good tube current and voltage. The realization of these adjustment functions and the control behaviour (proportional behaviour or integral behaviour) of the dose rate control during the relevant type of examination are chosen by the program after determination of the values for the next interval in the sampling controller.

Generally, the dose rate during the various types of examination is not determined by means of the same measurement device. For example, for a layer exposure the dose rate can be determined by means of an ionization chamber, while it is determined by means of a photomultiplier when use is made of a cinecamera and is derived from a video signal during fluoroscopy. In order to achieve dose rate control which is not dependent on the actual construction of the measurement device used, is a further version of the invention that there are a plurality of measurement devices, one of which is active during each type of examination. Matching amplifiers are provided which amlify the output signal of the measurement devices to a predetermined level for a predetermined dose rate. A switching device relevant couples the measurement device associated with the relevant examination to the controller.

In a further embodiment of the invention, the sampling frequency has a first value during a first part of an X-ray exposure and a second value during a subsequent part. The first value is substantially larger than the second value. Thus, an attractive start-up behaviour can be achieved when the first part is terminated with a high sampling frequency as soon as, for example, the tube voltage reaches a preset fraction of its starting value. Due to the increased sampling frequency, simpler and shortened control algorithms must be used during the first phase in order to ensure that a dose rate signal which is suitable for evaluation becomes available quickly for as long as the tube voltage does not yet deviate substantially from its starting value.

Figure 2:
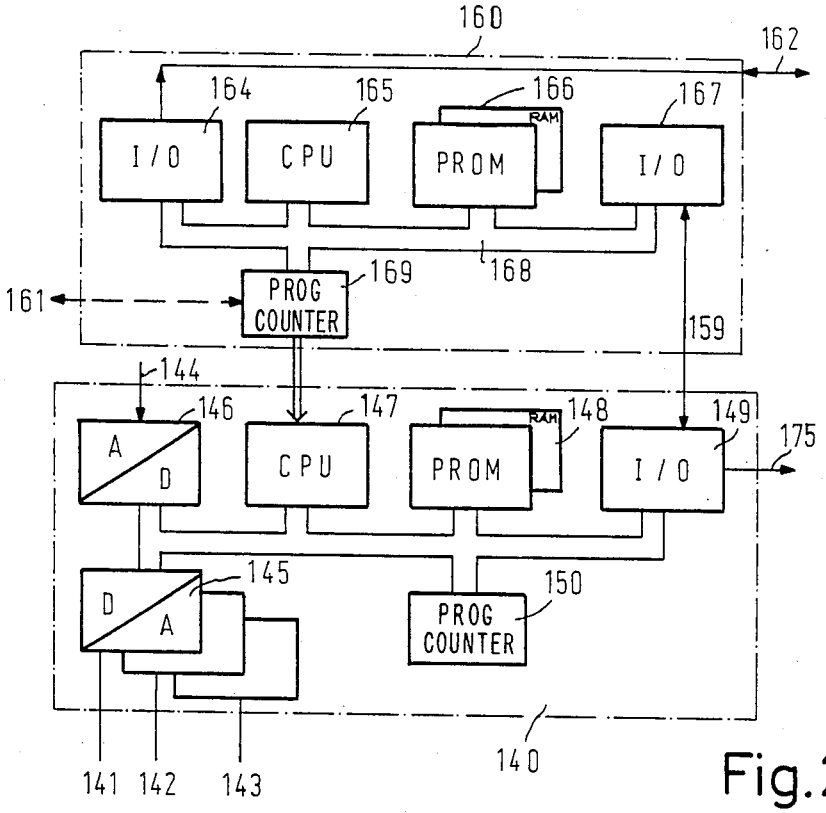
Figure 3A:
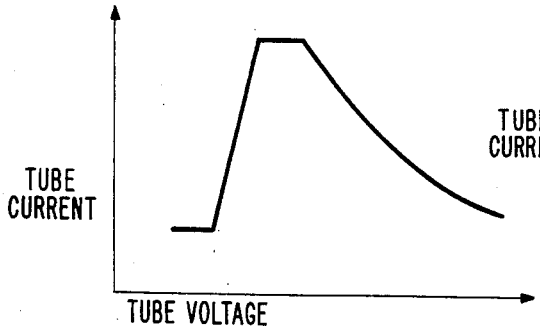
Figure 3B:
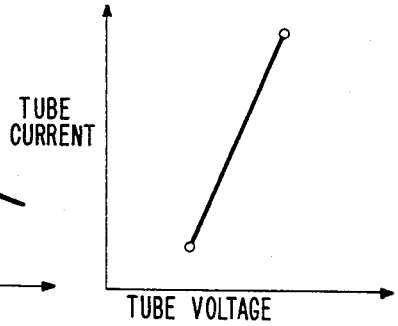

The invention will be described in detail hereinafter with reference to the drawings. Therein:

FIG. 1 shows a block diagram of an X-ray generator in accordance with the invention, FIG. 2 shows a block diagram of a part of the X-ray generator, and FIGS. 3*a* and 3*b* show adjustment functions for different types of examination.

FIG. 1 diagrammatically shows an X-ray system including an X-ray generator 1 and an X-ray tube 2 whose radiation passes through an examination region which is represented by the body 13 and which forms an X-ray shadow image on either a film positioned in a cassette holder 4 or on the exit screen of an X-ray image intensifier 5. When use is made of an X-ray film, the dose or the dose rate is measured by means of an ionization chamber 3 and applied to a unit 30 for dose evaluation. The exit image of the image intensifier 5 can be recorded by means of a cinecamera 7, a sheet or roll-film camera 8 or a television camera 9 via a television chain 90 which includes a monitor 91. An adjustable iris diaphragm 11 is arranged in the optical beam path.

The X-ray generator 1 includes, inter alia, adjustment means for adjusting the tube voltage, the tube current and the size of the focal spot. The adjustment means 100 for the tube voltage can include, for example an intermediate frequency converter with a combination of a high voltage generator and a rectifier. For the tube current adjustment means 110 use can be made of a grid control unit or an electronically controlled heating circuit; the focal spot adjustment means 120 may also be constucted so that it enables only switching over of the focal spot size between two values.

The adjustment signals for the adjustment means 100, 110 and 120 are supplied by a sampling controller 140 via lines 143, 141 and 142, respectively. The sampling controller receives its reference values and adjustment functions from a central control unit 160 and its actual values either from the ionization chamber 3, the photomultiplier 12 or the television chain 90, via matching amplifiers 171, 172 and 173 which amplify the output signals of these measurement means to a standardized level as well as via a switching device 170 which is controlled, via the line 175, so that the output signal of each time one of the three matching amplifiers 171 . . . 173 is applied to the sampling controller 140 via the line 144.

The central control unit 160 is connected, via a bidirectional connection 162, to a selection device in the form of a control panel 180. For example, by actuation of a key, the operator selects the type of examination, after which the associated sampling frequency and the adjustment function are addressed in a memory of the central control unit 160 in order to be loaded into a memory of the sampling controller 140 via the connection 159.

FIG. 2 shows the construction of the sampling controller 140 and the central control unit 160. Both elements include a microprocessor 147, 165, respectively, as well as read only memories and write/read memories 148 and 166, respectively, and input/output units 149, 164, 167, respectively. Both units include a programmable counter 150, 169. The sampling controller 140 also includes an analog-to-digital converter 146 for converting the analog signals representing the actual values on the line 144 into digital values, and a digital-to-analog converter 145 which converts the digital adjustment signals generated by the microprocessor 147 into analog signals which are applied to the associated adjustment means via the lines 141, 142 and 143.

For each type of examination, the optimum adjustment function, the necessary sampling frequency as well as further parameters, for example the image frequency, the minimum and the maximum exposure time (in the case of cineradiography) etc. are stored in the memory 166 of the central control unit 160. Via the bidirectional connection 162, these programs can be addressed on the control panel 180. Before the start of the exposure, they are transferred, via the input/output interface 167 of the central control unit 160 and the connection 159, to the input/output interface 149 of the sampling controller 140. The exposure time is adjusted by means of the programmable counter 169 which is activated by the exposure start signal and which generates, upon expiration of the exposure, a signal which interrupts, via the line 161 which in inter alia connected to the high voltage adjustment means 100, the tube voltage and hence the X-rays, and which acts on the microprocessor 147 in the sampling controller 140 via the interrupt line 158. In accordance with a program which is stored in the memory 148 and which is addressed in dependence of the relevant type of examination, the controller calculates within a sampling interval the adjustment signals for the next sampling interval.

The functions of the X-ray generator will be described in detail hereinafter for two different types of examination.

(A) Cineradiology

For this type of examination the cinecamera forms a plurality of X-ray images, generally between 50 and 300 images per second. Per se dose control per image is then required. Dose deviations which occur due to disturbances, however, must not be eliminated by control for each image, but instead by reference to some tens of images. Otherwise flicker will occur. The Therefore, the dose is a sampling signal which is available after each image and the sampling frequency thus corresponds to the image frequency.

It is assumed that after the $i^{th}$ image of a series of cinematographic images there is obtained a signal $D_i$ which serves to represent the dose received during this image. The dose required for the correct density of an image, however, is assumed to be $D_s$ and deviates from $D_i$. The adjustment signals required for the X-ray voltage adjustment means 100 and the tube current adjustment means 110 are caluculated as follows:

(A.1) First a tube voltage $U_x$ is calculated in accordance with the relation $$U_x = U_i * (D_s/D_i)^{1/a}$$

Therein, $U_i$ is the tube voltage adjusted during the last image and a is the exponent of the variation of the dose rate in reaction to a variation of the tube voltage. The voltage $U_x$ thus calculated represents the value which would be required in the case of a proportional control method where the dose or the dose power is controlled exclusively by variation of the tube voltage.

Subsequently, the tube current $I_x$ associated with $U_x$ is calculated in dependence of the adjustment function loaded for the relevant type of examination. FIG. 3*a* shows an adjustment function which is suitable for cineradiography. The curve plotted in the tube current-/tube voltage diagram indicates how the tube voltage and the tube current should be varied in order to obtain a variation of the dose rate. The curve starts for the smallest possible tube voltage and the smallest possible tube current with a horizontal portion, which means that in order to vary the dose rate only the voltage is varied in this portion. This portion is adjoined by a further portion in which the tube current and the tube voltage are varied in the same sense in order to vary the dose power. The second portion is followed by a third portion (again horizontal) which is determined by the maximum tube current. The third portion is followed by a fourth portion which is predetermined by the loadability of the focal spot of the X-ray tube and which has a hyperbolic shape. In this portion the tube voltage and the tube current are varied in an opposite sense in order to vary a dose rate so that their product remains constant. The adjustment function shown in FIG. 3*a* is stored since values of the tube current and the tube voltage at the beginnings and the ends of the individual portions are stored. For intermediate adjustment quantities (for example heating current) exhibiting non-linear dependencies on the tube current and the tube voltage, the description of the curve by way of beginnings and ends may be insufficient. In that case a plurality of points on the curve will be stored.

(A.3) After this determination of the tube current $I_x$ associated with the tube voltage $U_x$ by means of the adjustment function shown in FIG. 3*a*, a tube current variation $\Delta I_x$ is calculated in accordance with the formule $$\Delta I_x = h(I_x - I_i) + k(I_i - I_{i-1})$$

Therein, h is a factor which determines the proportional action of the control system, while the factor k defines the integral action. The valueL $I_{i-1}$ represents the tube current during the last image but one.

(A.4) Subsequently, the tube current to be adjusted for the next X-ray image is calculated in accordance with the relation $$I_{i+1} = I_i + \Delta I_x$$

(A.5) The tube voltage $U_{i+1}$ to be adjusted for the next X-ray image is calculated in accordance with the relation $$U_i + (U_x - U_i)(1 - C)$$

where $C=\Delta I_x/I_x$. The values of tube current and tube voltage thus calculated are applied as adjustment signals means 100 and 110, via the lines 143 and 141. The dose then occuring is measured again, after which the adjustment signals are calculated once more, etc.

Control can be performed in a similar way in the case of pulsed fluoroscopy where the actual value is derived from the signals of the television chain 90. However, a different sampling frequency and a different adjustment function may then be involved.

(B) Serialography using the roll film camera 8

For this type of examination, using image frequencies of up to 15 images per second, each image should be correctly exposed and the exposure duration may not exceed a lower limit frequency and an upper limit frequency. In order to ensure that the limits of the exposure duration are not exceeded for any individual exposure, the image forming dose rate must be controlled. An adapted sampling frequency is obtained from the shortest exposure time. When this exposure time amounts to from 10 to 20 ms, the sampling frequency should amount to approximately 1 kHz.

To this end, an internal divider of the clock frequency of the sampling controller is adjusted accordingly and is connected to an interrupt input of the central unit as soon as the tube voltage reaches its preset starting value. During each sampling interval thus initiated, the dose rate or the dose applied thus far is stored, via the analog-to-digital converter 146, as an actual value and the difference with respect to the reference value from the memory is determined. The adjustment parameters are then calculated as follows:

(B.1) First a voltage $U_x$ is calculated in accordance with the relation $$U_x=U_i(D_s/D_i)^{1/(a+1)}$$

(B.2) During the second step, a value $\Delta U_x$ is calculated, using the value $U_x$ thus calculated, in accordance with the formula $$\Delta U_x=m(U_x-U_i)+n(U_i-U_{i-1})$$

Therein, m is a factor determining the proportional action of the control system, n is a factor which determines the integral action of the control system, and $U_{i-1}$ is the value of the tube voltage during the last sampling interval but one.

(B.3) Subsequently, the next adjustment parameter for the tube voltage is calculated in accordance with the relation $$U_{i+1}=U_i+\Delta U_x$$

(B.4) During a further step, the associated tube current $I_{i+1}$ is determined on the basis of the adjustment function which is in this case defined in accordance with equation (B.3) by a straight line whose start and end points are stored.

The exposure is terminated when the reference dose required for the exposure is reached.

The control procedure is the same for layer images. However, because the exposure time is predetermined for such images, the exposures are terminated by means of a programmable counter.

For the previously described types of examination where, the individual image must already be correctly exposed, a particularly attractive start-up behaviour is obtained when at the beginning of an exposure the tube voltage is adjusted to a value which is substantially higher, for example 5 kHz, during the period of time between the instant of switching on and the instant at which approximately 95% of the starting value is reached. For this increased sampling frequency use must be made of a simpler and shortened control algorithms which deviate from the above algorithms in that on the one hand it must be detected whether an evaluatable dose rate is present and on the other hand a sufficiently fast variation of the tube voltage must take place when the dose rate measured is excessively high. This prevents overexposure of the X-ray image. After termination of the start-up procedure, the sampling frequency is adjusted to the above value (1 kHz).

What is claimed is:

1. In an X-ray generator which includes adjustment means for at least X-ray tube current and X-ray tube voltage, controller means which act on the adjustment means in response to an actual value of X-ray dose rate and a reference value of X-ray dose rate, at least one measurement device for measuring the actual value of the X-ray dose rate, and a selection device which can be activated by an operator and which defines a type of X-ray examination as well as the reference value of the dose rate, the improvement wherein the controller means is a controller which controls the adjustment means during each of a series of sample intervals and includes a microprocessor, first memory means (148, 166) in which sampling frequency and the adjustment functions are stored for the various types of examination, and second memory means; and wherein, the controller calculates, in accordance with an adjustment function and a program stored in the second memory means (148, 166), adjustment values for each sampling interval and controls the adjustment means accordingly.

2. An X-ray generator as claimed in claim 1, further comprising a plurality of measurement devices (3, 12, 90), each one of which is active during each distinct type of examination; matching amplifiers (171, 172, 173) which amplify an output signal of each measurement device to a predetermined level at a predetermined dose rate, and switching means (170) which couple the measurement device associated with the relevant examination to the controller.

3. An X-ray generator as claimed in any one of the preceding claims, wherein the controller has a sampling frequency which has a first value during a first part of an X-ray exposure and a second value during a subsequent part of said exposure, the first value being substantially larger than the second value.

* * * * *